US008286788B2

(12) United States Patent
Massotte et al.

(10) Patent No.: US 8,286,788 B2
(45) Date of Patent: Oct. 16, 2012

(54) MACHINE FOR THE THERMAL TREATMENT OF THREADS, EQUIPPED WITH A DEVICE FOR POSITIONING THE ADVANCING CONVEYOR BELT

(76) Inventors: Philippe Massotte, Gueberschwihr (FR); Michel Mazoyer, Pfastatt (FR); Serge Munschi, Rantzwiller (FR)

( * ) Notice: Subject to any disclaimer, the term of this patent is extended or adjusted under 35 U.S.C. 154(b) by 267 days.

(21) Appl. No.: 12/321,382

(22) Filed: Jan. 16, 2009

(65) Prior Publication Data

US 2009/0188772 A1 Jul. 30, 2009

Related U.S. Application Data

(60) Provisional application No. 61/067,248, filed on Feb. 27, 2008.

(30) Foreign Application Priority Data

Jan. 24, 2008 (FR) ..... 08 50452

(51) Int. Cl.
*B65G 21/00* (2006.01)

(52) U.S. Cl. ..... 198/861.1; 198/806; 198/807; 198/860.3

(58) Field of Classification Search ..... 198/806, 198/807, 860.3, 861.1
See application file for complete search history.

(56) References Cited

U.S. PATENT DOCUMENTS

| | | | | |
|---|---|---|---|---|
| 4,649,558 | A * | 3/1987 | Brunn et al. | 378/97 |
| 4,790,908 | A * | 12/1988 | Roerig et al. | 162/199 |
| 5,074,130 | A * | 12/1991 | Enderlin | 68/5 E |
| 5,117,969 | A | 6/1992 | Roth | |
| 5,699,898 | A * | 12/1997 | Bartelmuss et al. | 198/806 |
| 6,287,008 | B1 * | 9/2001 | Bartelmuss et al. | 384/247 |
| 6,405,854 | B1 * | 6/2002 | Cumberlege | 198/806 |
| 7,111,724 | B2 * | 9/2006 | Donnenhoffer | 198/807 |
| 7,475,765 | B2 * | 1/2009 | Nadeau et al. | 193/37 |
| 7,543,463 | B2 * | 6/2009 | Rhyne et al. | 68/5 D |
| 7,735,343 | B2 * | 6/2010 | Chochol et al. | 68/5 E |
| 7,866,462 | B2 * | 1/2011 | DeMong | 198/810.04 |

FOREIGN PATENT DOCUMENTS

| | | |
|---|---|---|
| EP | 1270457 A | 1/2003 |
| EP | 1627833 A | 2/2006 |
| EP | 1793027 A | 6/2007 |
| GB | 2071598 A | 9/1981 |
| GB | 2287687 A | 9/1995 |

* cited by examiner

*Primary Examiner* — Douglas Hess

(74) *Attorney, Agent, or Firm* — The Watson I.P. Group, PLC; Jovan N. Jovanovic; Vladan M. Vasiljevic

(57) ABSTRACT

The present invention relates to a machine for the thermal treatment of threads, which comprises a positioning mechanism (8) and a position control mechanism (9) acting on a very short area in the immediate proximity of each sealing head. The positioning mechanism (8) includes an axle (10) for pivoting the frame (3), connected directly to the frame (3), and an actuator (11) for pivoting the frame, which is acting on said frame (3) through the intermediary of a rod linkage (12), mounted between the edge of the frame (3) and the actuator (11). The device for positioning the conveyor belt (2) during its advance in the pressurized enclosure (1) is provided, with a mechanism for holding the conveyor belt (2) at a height separation with respect to the position control mechanism (9).

14 Claims, 2 Drawing Sheets

MACHINE FOR THE THERMAL TREATMENT OF THREADS, EQUIPPED WITH A DEVICE FOR POSITIONING THE ADVANCING CONVEYOR BELT

CROSS REFERENCE TO RELATED APPLICATION

This application claims priority from French Patent Application Serial No. 08 50452 flied Jan. 24, 2008. Additionally, this application claims priority from U.S. Provisional Patent Application Ser. No. 61/067,248 filed Feb. 27, 2008. The entire specification of both of these applications is incorporated herein in their respective entirety.

BACKGROUND OF THE INVENTION

The present invention concerns the field of textile industry, particularly the treatment of threads by means of thermal treatment machines that are commonly called heat setting machines, and its object is such a machine comprising a device for positioning the conveyor belt during its advance, which is equipped with means to hold the latter at a height separation with respect to the position control means.

The thermal treatment machines consist essentially of a pressurized enclosure for the thermal treatment of textile threads that are deposited on a conveyor belt, passing through said enclosure, which is closed at its two ends by sealing heads comprising each a frame or moving body holder fixed to the pressurized enclosure, a pair of superposed horizontal rollers, which are pressed against the opposite faces of the conveyor belt, and sealing means to form a sealing closure between the rollers and the frame.

The horizontal rollers are actuated by tightening means that allow the movement of at least one of the rollers in the direction of the other, to tighten them against the conveyor belt. In addition, the sealing heads are mounted, each through the intermediary of its frame or moving body holder, in a pivoting way with respect to a vertical median axis, and they are connected to the treatment enclosure through the intermediary of a bellows that extends between the vertical pivoting axis and the frame or moving body holder of said sealing heads.

During operation, the conveyor belt may undergo drift between the inlet and the outlet of the thermal treatment machine, which drift may result in jamming in the interior of the machine, if a predetermined limit is exceeded, and result at least in stoppages of the machine to correct the problem, and possibly in damage.

It has been proposed to solve this problem by providing a means for positioning the conveyor belt between the inlet and outlet heads, through the intermediary of cells for the detection of the position of said belt at the ends of the machine, i.e., close to the sealing heads, where these detection cells deliver a control signal for the modification of the position of the heads by means of actuators that act on the frame or moving body holder of the latter causing them to pivot. Such a pivoting of the sealing heads has the effect of modifying the position of the axis of the sealing rollers, so that the conveyor belt is adjusted in the opposite direction of the observed deviation, as a result of the clamping of the conveyor belt between the superposed horizontal rollers. Indeed, while the sealing head pivots, the conveyor belt is driven in a pivoting motion, because it is clamped between the longitudinal rollers, along a transverse generatrix, which induces a corresponding correction of the belt to correct its drift and return it to its normal operating position.

In general, the means for the detection and correction of the position of the conveyor belt of such machines are perfectly suited to ensure a correct positioning of said conveyor belt. However, a detection problem arises, and thus a problem in the correction of the deviation, if the conveyor belt is bent due to aging. Indeed, the sensors that detect the position of the conveyor belt at the inlet and at the outlet of the machine are sensitive to the deformation of this conveyor belt.

Moreover, because frames or moving body holders of the sealing heads are installed, each on a vertical pivoting axle provided at a distance from said frames or moving body holders of the sealing heads, it is necessary to take into account by anticipation the pivoting of said sealing heads, which is increased by a lever arm effect due to the distance between the pivoting axis and the plane of the superposed horizontal rollers, and due to the distance between the sensors and the heads, resulting in an amplification of the correction of the observed drift.

In addition, the installation of the sealing heads, in the manner described above, results in a considerable overhang of the heads, and thus corresponding stresses on the pivoting axis, requiring a corresponding dimensioning of all the mounting elements of said heads.

From FR-A-2 894 258, a device for positioning the conveyor belt is also known, for machines for the thermal treatment of threads that consist of a pressurized enclosure, through which a conveyor belt passes, and which is closed at each end by a sealing head mounted on a frame or moving body holder that is connected to the pressurized enclosure through the intermediary of a bellows, where each sealing head comprises a pair of superposed horizontal rollers which are pressed against the opposite faces of the conveyor belt. This device comprises a positioning means and a position control means acting on a very short area in the immediate proximity of each sealing head.

To this effect, the positioning means consists of a pivoting axle of the frame or moving body holder that is integrally connected directly to said frame or moving body holder, and of an actuator of the pivoting of the frame or moving body holder through the intermediary of a rod linkage connected to the actuator, which is of the jack screw type. The position control means consists of a proportional analog position sensor, which is arranged close to at least one edge of the conveyor belt, in proximity to the superposed horizontal rollers of the sealing head, where this sensor is connected to a calculation means that delivers a correction signal to a control servo-variator of the actuator of the means for positioning the frame or moving body holder. The sensor forming the position control means is an optic sensor, a pneumatic sensor, a Foucauld current sensor, or a probing sensor.

The device according to the last document makes it possible to ensure a good control of the drift of a conveyor belt, by continuous correction, regardless of what the advance speed of the belt is, and thus a correct positioning of said belt. However, its implementation still requires relatively complex means.

SUMMARY OF THE INVENTION

The purpose of the present invention is to propose a thermal treatment machine comprising a device for positioning the conveyor belt during its advance according to FR-A-2 894 258, which makes it possible to control and correct the drift of said conveyor belt continuously, while at the same time limiting the amplitude of the movements of the sealing heads, and being easier and thus less expensive to carry out.

To this effect, the machine for the thermal treatment of threads, which consists essentially of a pressurized enclosure through which a conveyor belt passes, and which is closed at each end by a sealing head mounted on a frame or moving body holder that is connected to the pressurized enclosure through the intermediary of a bellows, where each sealing head comprises a pair of superposed horizontal rollers, which are pressed against the opposite faces of the conveyor belt, and of a means for positioning the conveyor belt during its advance in the pressurized enclosure, which comprises a positioning means and a position control means acting on a very short area in the immediate proximity of each sealing head, where said positioning means consists of an axle for pivoting the frame or moving body holder that is integrally connected to said frame or moving body holder, and of a pivoting actuator of the frame or moving body holder that acts on said frame or moving body holder through the intermediary of a rod linkage installed between the edge of the frame or moving body holder and said actuator, which is in the form of at least one jack that is connected directly to the rod linkage for driving the frame or moving body holder in a pivoting motion, is characterized in that the device for positioning the conveyor belt during its advance in the pressurized enclosure is provided, on its side where the sensor extends, namely below or above the conveyor belt, with a means for maintaining the conveyor belt at a height separation with respect to the position control means.

BRIEF DESCRIPTION OF THE DRAWINGS

The invention will be understood better with the help of the following description, which relates to preferred embodiments that are given as nonlimiting examples, and explained in reference to the schematic drawing in the appendix, in which.

DETAILED DESCRIPTION OF THE DRAWINGS

Figure 1:
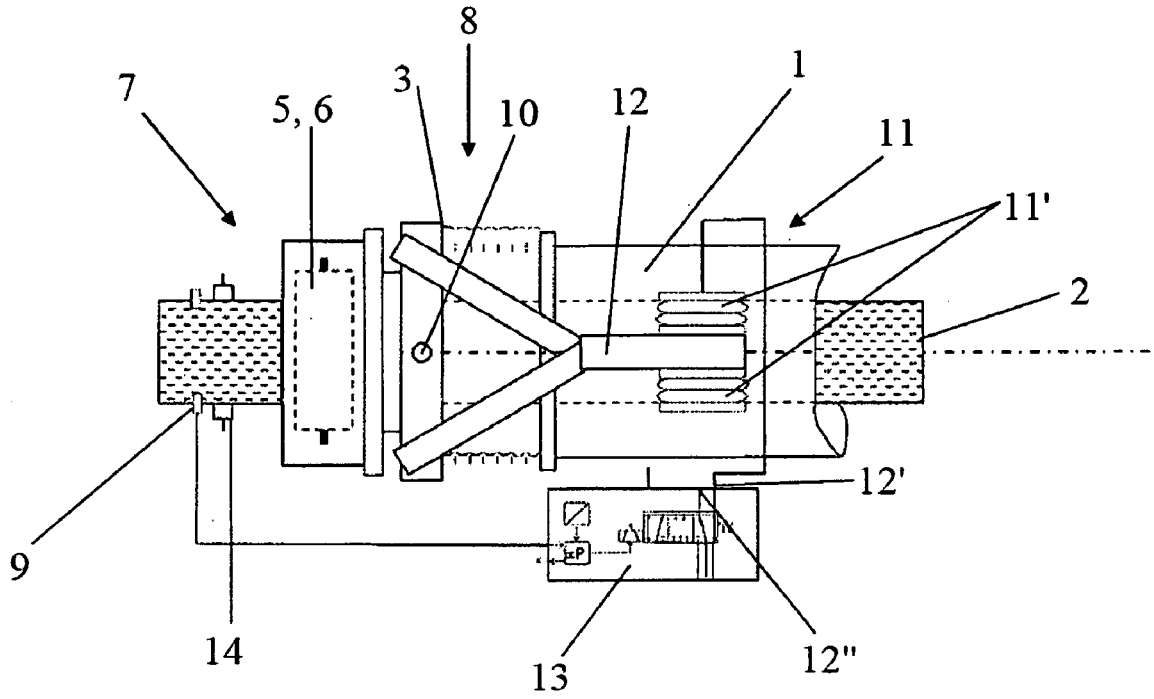
FIG. 1 is a partial plan view of a machine for the thermal treatment of threads, which is equipped with the device according to the invention.

FIG. 1 of the drawing in the appendix represents, as an example, a machine for the thermal treatment of threads, which consists essentially of a pressurized enclosure 1 through which a conveyor belt 2 passes, and which is closed at each end by a sealing head mounted on a frame or moving body holder 3 that is connected to a pressurized enclosure 1 through the intermediary of a bellows 4, where each sealing head comprises a pair of superposed horizontal rollers 5, 6, which are pressed against the opposite faces of the conveyor belt 2. To prevent an inadmissible drift of the conveyor belt, this machine for the thermal treatment of threads is equipped with a positioning device 7 for positioning this belt.

The positioning device 7 comprises a positioning means 8 and a position control means 9 acting on a very short area in the immediate proximity of each sealing head.

This positioning means 8 consists, according to the embodiment of FIG. 1, of an axle 10 for pivoting the frame or moving body holder 3, which is integrally connected directly with said frame or moving body holder 3, and of an actuator 11 that actuates the pivoting of the frame or moving body holder 3 through the intermediary of a rod linkage 12 mounted between the edge of the frame or moving body holder 3 and said actuator 11, which is in the form of at least one jack that is connected directly to the rod linkage 12 for driving the pivoting motion of the frame or moving body holder 3.

Only one end of the machine for the thermal treatment of threads is represented in a plan view in FIG. 1, so that only one roller of the pair of rollers 5 and 6 forming the sealing head is visible. Moreover, it is clear that the end that is not shown of the machine for the thermal treatment of threads is symmetric to the one represented in FIG. 1.

According to the invention, the device for positioning the conveyor belt 2 during its advance in the pressurized enclosure 1 is provided, on the side where the sensor extends, namely below or above the conveyor belt 2, with a means for holding the conveyor belt 2 at a height separation with respect to the position control means 9. Such a device is adapted more particularly for an embodiment with sensors according to the present invention, which are described below.

To this effect, according to a first embodiment of the invention, the means for holding the conveyor belt 2 at a height separation with respect to the position control means 9 can be in the form of a transverse support roller 14, which extends in the immediate proximity of the sensor that forms the position control means 9, and is shifted slightly downward or upward, where said conveyor belt 2 constitutes each sealing head (FIG. 2), with respect to the inlet or outlet of the superposed horizontal rollers 5, 6.

Such an arrangement of the transverse support roller 14 between the outlet and the inlet of the sealing heads and the sensor forming the position control means 9 makes it possible to ensure a sufficient tension on the conveyor belt 2, so that a vertical displacement of the edge(s) of the conveyor belt 2, which passes over the sensor forming the position control means 9, is held constantly at the same vertical distance from said sensor 9. It follows that the load of the conveyor belt 2 cannot influence the width of this belt 2, by bending, so that its width remains uniform, and the sensor forming the position control means 9 detects only a transverse displacement of the belt 2, so that a measurement without disturbance by the sensor forming the position control means 9 is ensured.

According to another embodiment variant of the invention, it is also possible for the means to hold the conveyor belt 2 at a height separation with respect to the position control means 9 to be in the form of a pair (not shown) of guide rollers, which are provided in the immediate proximity of the sensor forming the position control means 9, on each edge of the conveyor belt 2, and maintain the edge(s) at a constant height separation from said sensor.

According to another embodiment variant of the invention, which is not represented in the drawing of the appendix, the means for holding the conveyor belt 2 at a height separation with respect to the position control means 9 can also be in the form of a transverse support skid that shifts said conveyor belt 2 upward.

According to another characteristic of the invention, the position control means 9, which is in the form of at least one proportional analog position sensor, is chosen from the group consisting of inductive sensors and pressure sensors.

Preferably, and as shown more particularly in FIG. 1 of the drawing of the appendix, the actuator 11 is in the form of a pair of flexible or membrane jacks with membranes 11', each acting on one side of the free end of the rod linkage 12 for driving the frame or moving body holder 3 in a pivoting motion. Such flexible or membrane jacks 11' are extremely responsive and allow controlled displacements of very small amplitude.

Thus, it is possible to carry out, with a very small response time, pivoting motions with perfectly controlled amplitude, of the frame or moving body holder 3, so that the sealing head, which consists of the rollers 5 and 6, is pivoted about its pivoting axle 10, and causes a displacement of the conveyor belt 2 in the opposite direction of the observed drift.

According to an embodiment variant of the invention, which is not represented in the drawing of the appendix, the actuator 11 can be in the form of a single-acting jack, which acts on a side of the free end of the rod linkage 12 for driving the frame or moving body holder 3 in a pivoting motion, and which is returned to its position through the intermediary of a return spring. In such a case, the chamber of the jack is continuously supplied with a pressure that varies as a function of the desired displacement of the rod linkage. Thus, an increase in the pressure will have the consequence of a displacement of the rod linkage against the action of the return spring, and a decrease of this pressure will have the consequence of a displacement in the opposite direction, proportionally to this decrease in pressure. Naturally, the displacement of the rod linkage, under the action of the pressure exerted on the piston of the jack, or the pressure exerted in the opposite direction by the spring, can be controlled by an angular position sensor or similar device.

According to another embodiment variant of the invention, which is not represented in the drawing of the appendix, it is also possible to produce the actuator 11 in the form of a dual-acting jack, which acts on the free end of the rod linkage 12, and whose chambers are alternately supplied with pressure. In such an embodiment, it is sufficient to supply one or the other chamber of the dual-acting jack to achieve the displacement of the rod linkage 12, and thus a pivoting of the frame or moving body holder 3 in one direction or the other. In such a case, the two opposite chambers of the dual-acting jack are each connected to the casing with interposition of a throttling means that allows a perfect control of the displacement of the piston rod, particularly without knocking.

Finally, it is also possible to produce the actuator 11 in the form of a dual-action jack (not shown) whose body is connected to the free end of the rod linkage 12, and where each of its piston rods is connected to a fixed support provided on the corresponding side of the frame of the treatment machine. In such a case, the pressure chamber of each jack is also connected advantageously to the casing through the intermediary of a throttling means.

According to another characteristic of the invention, the position control means 9, in the form of at least one proportional analog position sensor, is an inductive sensor (FIGS. 1 and 2), which is positioned as close as possible to the frame or moving body holder 3, above or below the conveyor belt 2, straddling the edge. Thus, any shift of the belt away from its normal path under the inductive sensor that forms the position control means 9 will have the consequence of disturbing or modifying the magnetic field at the level of said sensor 9, so that a corresponding variation signal is emitted.

According to a characteristic of the invention, the inductive sensor that forms the position control means 9 is connected to an analog proportional distributor 13 that controls the actuator 11. Such a distributor makes it possible, for example, to feed—through its outputs 12' and 12"—the two flexible or membrane jacks 11', each acting on one side of the free end of the rod linkage 12 for driving the frame or moving body holder 3 in a pivoting motion. Because such a distributor presents a relatively short response time, namely a few milliseconds, and a very high output, it is capable of equilibrating the pressure in the jacks 11' and 11" almost instantaneously. Naturally, such a proportional distributor is also adapted to the control of the other above-mentioned jack types.

It is also possible, according to an embodiment variant of the invention, to arrange the inductive sensor that forms the position control means 9 between the transverse support roller 14 and the superposed horizontal rollers 5, 6 constituting each sealing head.

According to an embodiment of the invention, which is not represented in the drawing of the appendix, the inductive sensor forming the position control means 9 and the actuator 11 can be unique for the entire machine, where the rod linkage 12 for driving the frame or moving body holder 3 that is connected to the actuator 11 in a pivoting motion is then connected to the rod linkage 12 of the opposite frame or moving body holder 3, or connected directly to the opposite frame or moving body holder 3, by a reverse command. Such a reverse command can consist, for example, of a connecting rod that is connected by one end to a side of the frame or moving body holder 3 of one end of the machine, and by its other end to the opposite side of the frame or moving body holder 3 of the opposite end of the machine.

Figure 3:
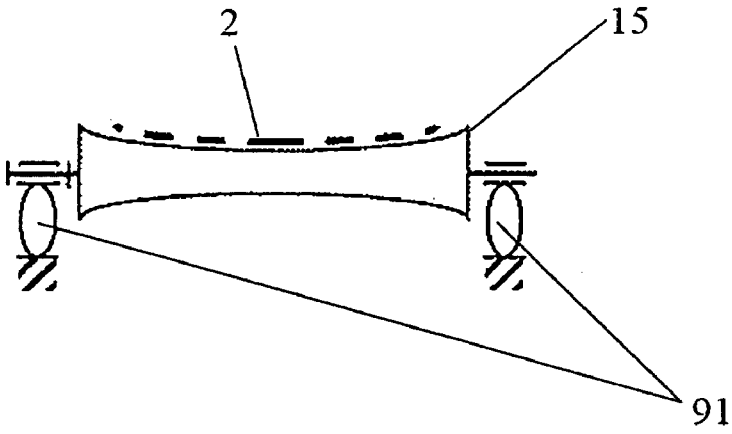
FIG. 3 is a transverse cross section of the conveyor belt immediately after the frame or moving body holder, with the use of an embodiment variant of the invention.

FIG. 3 of the drawing of the appendix represents an embodiment variant of the invention, in which the position control means 9 consists of pressure sensors 91 that work in cooperation with the bearings of a concave transverse roller 15 for supporting the conveyor belt 2, where said pressure sensors 91 actuate the rod linkage 12 for pivoting the frame or moving body holder 3 through the intermediary of an actuator 11 that is controlled by an analog proportional distributor 13.

Figure 2:
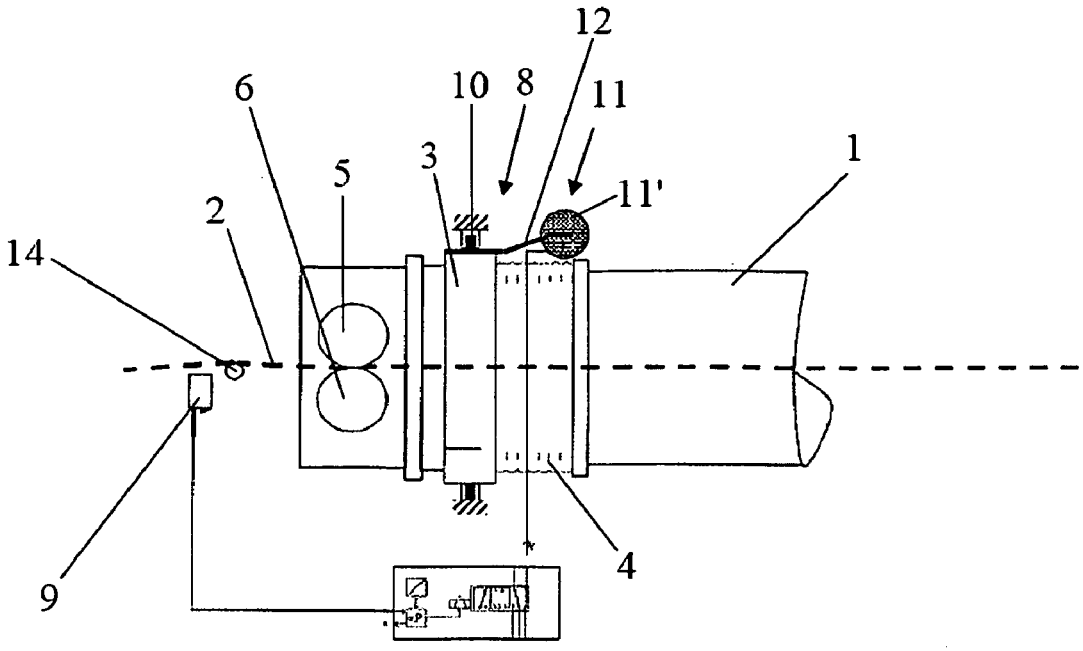
FIG. 2 is a lateral elevation view of the device according to the figure.

In this embodiment, the elements for actuating the pivoting motion of the frame or moving body holder 3 and the analog proportional distributor 13 are not represented in FIG. 3, but they can be identical to those represented in FIGS. 1 and 2. In the last embodiment, a transverse displacement of the conveyor belt 2 will have the consequence of increasing the load on one end of the concave transverse support roller 15, so that the pressure sensor 91 assigned to the corresponding bearing of said roller 15 will detect a pressure that is greater than that of the sensor 91 assigned to the opposite bearing, and the analog proportional distributor will deliver a control signal that is proportional to the observed difference in pressure, so that the sealing head will be pivoted by a value corresponding to the necessary correction of the trajectory of the conveyor belt 2.

The functioning of the device according to the present invention, particularly concerning the correction of the belt, is similar to the one described in reference to the device according to the document FR-A-2 894 258, namely, it consists in carrying out pivoting motions of very small amplitude, of the frame or moving body holder 3, and thus of the sealing head consisting of the rollers 5 and 6, in such a way as to cause a displacement of the conveyor belt 2 in the direction opposite the observed drift.

According to the invention, it is possible to achieve a perfect control of the drift of a conveyor belt, which may be perfectly new and corrected, or which may be used, and present deformations such as a sag or corrugations, by a continuous correction of said drift. Thus, the invention makes it possible to achieve a perfect positioning of a conveyor belt 2 of large length, over a predetermined portion of its length, as the belt advances continuously in a plane.

In addition, the use of two groups comprising a position control means 9 and an actuator 11 makes it possible, by prior regulation of these groups, to achieve a perfect control of the actions performed in the back and in the front of the machine, and even to obtain a slightly different actuation between the two ends, for example, a greater correction of the advancing belt at the outlet of the machine compared to the inlet of the machine, or vice versa.

In addition, the use of inductive sensors or of a pressure sensor allows a prior positioning of the corresponding sealing head, with regulation of the position of the conveyor belt 2 from the start of the operation of the machine.

Finally, by adjusting the pressure in the jack(s) forming the actuator 11, the stiffness of the system can be modified, i.e., the pivoting movements of the frame or moving body holder 3 can be more or less abrupt.

Naturally, the invention is not limited to the embodiments that are described and represented in the drawing of the appendix. Modifications remain possible, notably from the viewpoint of the constitution of the different elements or by the substitution of equivalent techniques, without exceeding the scope of protection of the invention.

What is claimed is:

1. Machine for the thermal treatment of threads, comprising a pressurized enclosure (1), through which a conveyor belt (2) having opposite faces passes, and which is closed at each end by a sealing head mounted on a frame or moving body holder (3), which is connected to the pressurized enclosure (1) through the intermediary of a bellows (4), where each sealing head comprises a pair of superposed horizontal rollers (5, 6), which are pressed against the opposite faces of the conveyor belt (2), and by a device for positioning the conveyor belt (2) during its advance in the pressurized enclosure (1), which comprises a positioning means (8) and a position control means (9) acting on a very short area in the immediate proximity of each sealing head, where said positioning means (8) consists of an axle (10) for pivoting the frame or moving body holder (3), which is integrally connected directly to said frame or moving body holder (3), and of an actuator (11) that actuates the pivoting of the frame or moving body holder (3), acting on said frame or moving body holder (3) through the intermediary of a rod linkage (12), which is mounted between the edge of the frame or moving body holder (3) and said actuator (11), which is in the form of at least one jack that is connected directly to the rod linkage (12) for driving the frame or moving body holder (3) in a pivoting motion, characterized in that the device for positioning the conveyor belt (2) during its advance in the pressurized enclosure (1) is provided, on the side over which a sensor forming the position control means (9) extends, namely below or above the conveyor belt (2), with a means for holding the conveyor belt (2) at a height separation with respect to the position control means (9).

2. Machine according to claim 1, characterized in that the means for holding the conveyor belt (2) at a height separation with respect to the position control means (9) is in the form of a transverse support roller (14), which extends in the immediate proximity of the sensor forming the position control means (9) and is shifted slightly downward or upward, where said conveyor belt (2) constitutes each sealing head with respect to the outlet or the inlet of the superposed horizontal rollers (5, 6).

3. Machine according to claim 2, characterized in that an inductive sensor forming the position control means (9) is arranged between the transverse support roller (14) and the superposed horizontal rollers (5, 6) constituting each sealing head.

4. Machine according to claim 1, characterized in that the means for holding the conveyor belt (2) at a height separation with respect to the position control means (9) is in the form of a pair of guide rollers, which are provided in the immediate proximity of the sensor forming the position control means (9), on each edge of the conveyor belt (2), and maintaining the edge(s) at a constant height separation from said sensor.

5. Machine according to claim 1, characterized in that the means for holding the conveyor belt (2) at a height separation with respect to the position control means (9) is in the form of a transverse support skid that shifts said conveyor belt (2) upward.

6. Machine according to claim 1, characterized in that the position control means (9), in the form of at least one proportional analog position sensor, is chosen from the group consisting of inductive sensors and pressure sensors.

7. Machine according to claim 6, characterized in that an inductive sensor forming the position control means (9) and the actuator (11) are unique for the assembly of the machine, where the rod linkage (12) for driving the frame or moving body holder (3) in a pivoting motion, which is connected to the actuator (11), is connected to the rod linkage (12) of the opposite frame or moving body holder (3), or connected directly to the opposite frame or moving body holder (3), by means of a reverse command.

8. Machine according to claim 6, characterized in that the position control means (9) consists of pressure sensors (91) that work in cooperation with a plurality of bearings of a concave transverse support roller (15) of the conveyor belt (2), where said pressure sensors (91) actuate the rod linkage (12) for pivoting the frame or moving body holder (3) through the intermediary of an actuator (11), which is controlled by an analog proportional distributor (13).

9. Machine according to claim 1, characterized in that the actuator (11) is in the form of a pair of flexible or membrane jacks (11') acting each on a side of a free end of the rod linkage (12) for driving the frame or moving body holder (3) in a pivoting motion.

10. Machine according to claim 1, characterized in that the actuator (11) is in the form of a single-acting jack acting on a side of a free end of the rod linkage (12) for driving the frame or moving body holder (3) in a pivoting motion and returned to its position through the intermediary of a return spring.

11. Machine according to claim 1, characterized in that the actuator (11) is in the form of a dual-acting jack which acts on a free end of the rod linkage (12), and presents chambers that are supplied alternatively with pressure.

12. Machine according to claim 1, characterized in that the actuator (11) is in the form of a dual-acting jack having piston rods whose body is connected to a free end of the rod linkage (12), and where each of the piston rods is connected to a fixed support provided on the corresponding side of the frame of the treatment machine.

13. Machine according to claim 1, characterized in that the position control means (9), in the form of at least one proportional analog position sensor, is an inductive sensor positioned as close as possible to the frame or moving body holder (3) above or below the conveyor belt (2), straddling an edge thereof.

14. Machine according to claim 13, characterized in that the inductive sensor forming the position control means (9) is connected to an analog proportional distributor (13) for controlling the actuator (11).

* * * * *